United States Patent [19]

Eigenmann

[11] Patent Number: 4,990,024

[45] Date of Patent: Feb. 5, 1991

[54] PREFORMED POLYURETHANE ROADWAY-MARKING STRIP WHICH IS HIGHLY CONFORMANT TO ROAD SURFACE ROUGHNESS

[75] Inventor: Ludwig Eigenmann, Vacallo, Switzerland

[73] Assignee: Minnesota Mining and Manufacturing Co., St. Paul, Minn.

[21] Appl. No.: 193,477

[22] Filed: May 12, 1988

Related U.S. Application Data

[63] Continuation of Ser. No. 916,452, Oct. 6, 1986, abandoned, which is a continuation of Ser. No. 716,234, Mar. 26, 1985, abandoned.

[30] Foreign Application Priority Data

| | | | |
|---|---|---|---|
| Mar. 26, 1984 | [CH] | Switzerland | 1498/84-9 |
| Oct. 29, 1984 | [CH] | Switzerland | 5149/84-4 |
| Oct. 29, 1984 | [CH] | Switzerland | 5150/84-0 |
| Feb. 13, 1985 | [CH] | Switzerland | 0046/85-0 |

[51] Int. Cl.[5] ..... E01F 9/08; G02B 5/12

[52] U.S. Cl. ..... 404/12; 404/14

[58] Field of Search ..... 404/9, 12, 14, 93; 428/67, 325; 523/172; 156/326

[56] References Cited

U.S. PATENT DOCUMENTS

| | | | |
|---|---|---|---|
| Re. 31,669 | 9/1984 | Eigenmann | 404/14 |
| 3,337,391 | 8/1967 | Clayton et al. | 156/326 |
| 3,656,360 | 4/1972 | Fix | 428/160 |
| 3,787,349 | 1/1974 | Eliasson | 523/172 |
| 3,908,055 | 9/1975 | Susuki et al. | 404/12 X |
| 3,935,365 | 1/1976 | Eigenmann | 428/325 |
| 4,020,211 | 4/1977 | Eigenmann | 404/14 |
| 4,069,281 | 1/1978 | Eigenmann | 404/14 |
| 4,101,704 | 7/1978 | Hiles | 428/325 |
| 4,154,638 | 5/1979 | Franz et al. | 156/326 |
| 4,299,874 | 11/1981 | Jones et al. | 404/14 |
| 4,653,854 | 3/1987 | Miyata | 404/14 |
| 4,725,494 | 2/1988 | Belisle et al. | 428/325 |
| 4,767,659 | 8/1988 | Bailey et al. | 428/325 X |
| 4,808,471 | 2/1989 | Grunzinger | 428/325 |

*Primary Examiner*—Ramon S. Britts
*Assistant Examiner*—Mathew Smith
*Attorney, Agent, or Firm*—Robert A. Elwell; Harold D. Jastram

[57] ABSTRACT

The polyurethane-resin layer and adhesive layer marking strip composition is conformant to the roadway without tearing, has a high elongation, a high permanent deformation, and a low elastic return due to high molecular weight and high sterical impediment.

One example of a high molecular weight and high sterical impediment is a sterically-impeded high-volume aromatic ring which reduces crystallization.

12 Claims, No Drawings

PREFORMED POLYURETHANE ROADWAY-MARKING STRIP WHICH IS HIGHLY CONFORMANT TO ROAD SURFACE ROUGHNESS

This application is a continuation of Serial No. 916,452, filed Oct. 6, 1986, abandoned which is a continuation of Ser. No. 716,234 filed Mar. 26, 1985, now abandoned.

When referring to polyurethane resin in this Application for an industrial-invention Patent, all isocyanate polymers or copolymers—singly or in combination with other polymers - are meant to be included.

The Applicant has developed many inventions in the field of roadway marking tapes and has received many patents in several different countries. These inventions all derive from the original preformed roadway-marking strip, which was basically a calendered elastomer and which was introduced on the world market right after the end of the second world war.

In the above-mentioned inventions, the expanded or calendered supporting strip layer is typically covered with a polymeric layer of material which, being very resistant to wear and providing high anti-skid capability, provides long-lasting roadway-marking service.

Through these inventions made by the Applicant, the preformed road-marking strips became "composite" structures, with a supporting layer of rubber elastomer and a top anti-wear layer, the latter being the object of the patented technological developments. The support layer is generally modified as required by the new product, and is rarely mentioned in the Applicant's inventions (see the formulation of Example No. 2, Patent No. 3,935,365 obtained in the USA).

A special road-marking sector is the removable type of preformed road-marking strip, the removal being done either manually or by means of a machine. This type is especially useful when roadwork is being done and deviations or detours are necessary. The Applicant's Re 31,669, the Reissue of Patent No. 4,146,635, covers a removable preformed roadway-marking strip whose supporting layer is an impregnated non-woven material having high mechanical characteristics. This non-woven material guarantees removability even after many months of use. It is completely impregnated by an impregnating material but is also partially permeated by the material which constitutes the lower adhesive layer and partially by the top layer which is the actual marking surface.

This present Application is a further development based on Swiss Patent Applications Nos. 1498/84-9, 05149/84-4 and 05150/84-0, the first applied for on March 26, 1984, and the second two on October 29, 1984.

It was discovered that, if appropriately formulated, the wear resistant polyurethane resin layer, together with the relative adhesive layer, can supply the required support without having to necessarily use the layer of calendered elastomer.

In fact, such are the intrinsic mechanical properties of such a layer of polyurethane support material that its required thickness can be considerably less than that of the layer of calendered elastomer. It never has to be more than one millimeter in thickness and thus provides greater advantages as regards conformance to surface irregularities.

This polyurethane layer has to be of the aliphatic type, at least at the top marking-layer surface, in order to have the proper weather-resistant properties. It needs therefore, to be produced in the factory at high temperatures.

The polyurethane layer can be so effective as to permit the elimination of the non-woven fabric from the composition, at least where removable roadway-marking strips designed for relatively short service life are concerned. Constructed in this manner, the road-marking strip consists of just the polyurethane-resin layer —opportunely formulated —adhesive on the bottom side. The fundamental characteristics of this marking-strip composition (polyurethane-resin layer and special layer, or film, of adhesive material) must be its ability to conform to roadway-surface roughness without tearing occuring at any point. In order to have this capability, it was found that the polyurethane-resin support layer has to be quite free, in the lower part of the layer, of catadioptric elements, pigments and fillers. The upper roadway-marking surface does, of course, have to have pigments, such as, for example, titanium oxide, to the extent of not less than 9%.

The polyurethane resin, to be conformable, must also have properties of high elongation, high permanent deformation, high tearing resistance and low elastic return.

The elongation to breakage should be at least 50%, and the permanent deformation should not be less than 15%. It was found that by choosing a structure that had a high molecular weight and high sterical impediment, such as sterically-impeded high-volume aromatic rings, the tendency to crystallize was reduced and a product having the desired properties was more easily obtained. Along this line, the following aromatic ethoxylated products gave the desired properties:

bisphenol and ethylene oxide
bisphenol and propylene oxide
resorcinol and ethylene oxide
resorcinol and propylene oxide
n,n bis (hydroxyethyl) aniline The obtained results can be further improved and made much more conformant to the desired end product by using tri- or tetrafunctional ramifications which are made bifunctional by stopping one or two of these chains, possibly the long ones, in order to prevent the association of the polymer main molecules. Tri- or tetradimensional polyalcohol molecules, blocked into just two reactive groups by means of monoisocyanates or fatty acids can be used. Triols, having a molecular weight of from 900 to 6000, are especially effective.

The following are specific examples:

blocked with monoisocyanates:
- castor oil
- polyester triols (m.w. up to 4000)
- polyether triols (m.w. up to 6000)
- polybutadiene triol
- blocked with oleate:

pentaerythrol dioleate
trimethyl-propane mono-oleate

The following is an example of carrying out the invention:

Preparation of the prepolymer:
- polyester: 1000 p.
- hydroxyalkylbisphenol: 800 p.
- castor oil, partially esterified: 800 p.
- IPDI : 2000 p.
- $TiO_2$ : amt. req'd xylene: 190 p.

When producing the strip, the prepolymer is polymerized in the ratio of 100 to 64 with the following mixture:

polyester diol: 100 p.
hydroxyalkylbisphenol: 50 p.
tinoctoate: amt. req'd

Alkylbisphenol has an inelastic structure, high molecular volume, high steric impediment, increases breaking modulus and reduces return speed. Treated castor oil increases tear resistance, permanent deformation and reduces return speed.

Another example of the invention is as follows:

IPDI: 127 gr
pblypropylene glycol (m.w. 1000): 68 gr
bis-hydroxypropylbisphenol: 9 gr
pentaerythritol dioleate: 113 gr To 100 gr of this prepolymer, the following is added:

polyethylene adipic glycol (m.w. 2000) : 63 gr
n,n bis-hydroxyethylaniline: 12 gr
tinoctoate catalyst : amt req'd The low elastic return after deformation of this product results in improved marking-strip efficiency because the catadioptric glass elements in the strip are not easily released by the strip under the mechanical action produced by the traffic. The best way to produce the marking strip is to lay the liquid polyurethane film onto a solid self-adhesive film, which is applied to release paper, and then proceed with the reticulation to harden the film. This polyurethane film plus the self-adhesive film form a single structure which has the mechanical purpose of resisting to the action of the traffic wear. The following is an example of a solid self-adhesive formulation which applies to this present invention:

CARIFLEX: 1107 100 p.
POLYSAR BUTYL: 30 p.
VISTANEX LMMH: 50 p.
PENTALIN H: 135 p.
HERCOLIN D: 30 p.
IRGANOX 1010: 1 p.
CKR 1634 RESIN: 5 p.

The components are all melted together

The support film can be made cheaper by applying a TDI-based film to the solid adhesive.

An example of this film is:

polyester: 1000 p.
hydroxyalkylbisphenol: 800 p.
castor oil, partially esterified: 800 p.
TDI: 1570 p
$TiO_2$ : amt. req'd
xylene: 190 p.

This support film, as described, with a thickness of, say, 2 tenths of a millimeter, is covered with a film of polyurethane resin of the IPDI type, as described above, which is weather resistant. Anti-skid material is introduced into this resin film, such as carborundum particles, for example, and catadioptric elements, such as, for example, glass beads.

The marking strips on the market today, which incorporate catadioptric elements, have the big drawback of having a short optical service life, not long enough for the specific application. Glass catadioptric elements have a tendency to be expulsed from the strip, after a more-or-less short time, as a result of the mechanical action of the traffic wear. In this regard, we cite the final report, "Performance of Preformed Plastic Tapes", dated Oct., 1982, by the Virginia Highway and Transportation Research Department.

Better results are obtained with preformed roadway-marking strips using polyurethane resin, but the results are still not satisfactory. Of course, the expulsion of the glass catadioptric elements from the strip is not only a function of the retention capability of the film but, also, a function of the mechanical expulsion action on the element from the polyurethane resin subjected to mechanical stress. It is evident that the slower the elastic return and the less said elastic return, the less chance there is of expulsion. The most important factor, however, is the attachment of the catadioptric glass elements to the polyurethane resin. It has been found that organic silanes or orthotitanates containing at least two active hydrogens—that is, hydrogens that can react with the isocyanics groups of the prepolymer—produce films that form a considerable bond between the film and the catadioptric elements, because silanes or orthotitanates act as chain extenders and the chains chemically bond themselves to both the glass and the urethane polymer.

The chains extenders must be at least bifunctional. This is important because a monofunctional extender will produce a product having very low mechanical characteristics. The active hydrogens can be of the hydroxyl type, such as in butandiol, or the amine type, such as in ethylendiamine. Treatment of the glass catadioptric elements with either of the chain extenders, silane or orthotitanate, is best done in a rotary mixer at low or medium temperature. Best results are obtained with Union Carbide Silane A 1120 or Dow Corning Silane 6020 and, for the titanate, with isopropyltriricinoiltitanate. About 0,5% Silane 1120 at 90° C. is applied to the beads. The beads thus coated are then immersed in the urethane prepolymer, which constitutes the upper layer of the road-marking strip. The silane amine groups thus bond themselves to the isocyanics groups of the reactive mixture and form a very tenaceous silane-urethane layer. This urethane prepolymer, which has,; to react with the chain extender, must therefore have a slight stoichiome excess.

If the catadioptric elements are to be properly stored, they must be covered with the chain extender, first of all, and then treated with the urethane prepolymer at 70–80° C.; when the reaction is terminated the catadioptric elements can be stored.

The film formed by first covering the catadioptric elements with the chain extender and then with the urethane resin has very high mechanical strength characteristics, as regards the bond created between the catadioptric elements and the urethane resin, thus making it more difficult for the catadioptric elements to be ejected from the urethane resin by the traffic wear.

It has been found that the polyurethane resin, as described above, works very well also for impregnating the non-woven fabric used in the production of removable roadway-marking strip and maintains its removability efficiency even after a considerable length of service (see Reissue No. 31,669 mentioned earlier). Since the nonwoven fabric extends the service life of the roadway-marking strip, strips manufactured in this manner are characterized by having a long service life. The preformed roadway-marking strip consists, actually, of two layers of polyurethane resin, the upper layer—which provides long marking-strip service life characteristics— being further reinforced by the protective action of the impregnated layer.

The marking strip not only has an exceptionally long service life but also has high conformability properties as regards roadway surface roughness. The presence of the non-woven fabric in the strip, furthermore, provides the guarantee of being able to remove the marking strip at any particular moment in its long service life.

When the marking strip is applied using the self-adhesive, which is done at room temperatures, removal is done manually When the strip is applied using a molten adhesive, removal is done by a machine, using heat.

Insertion of the non-woven fabric is best done after having first laid the support layer, according to the two-layer technique, and before laying the marking film layer onto this support layer.

I claim:

1. A preformed roadway-marking strip made of polyurethane and characterized by the fact that it is wear resistant and has a roadway-marking function by the inclusion of anti-skid elements and light-retroreflecting elements, and by a solid self-adhesive film which has the function to attach the marking strip to the roadway surface and, at the same time, together with the polyurethane film to resist traffic wear.

2. A preformed roadway-marking strip comprising a polyurethane resin film and including:

(i) a lower layer free of catadioptric elements;

(ii) an adhesive layer supported on the bottom side; and (iii) an upper aliphatic layer including at least 9% pigment and catadioptric elements;

said polyurethane having a sterical hindrance in its chemical structure in the form of high volume aromatic rings so as to provide said polyurethane with a reduced tendency to crystallize at least 50% elongation to breakage and at least 15% permanent deformation.

3. A preformed roadway-marking strip as in claim 2, wherein said sterical hindrance is obtained by using polyols from the group including polyesters and polyethers in which at least on branch is pending and inert.

4. A preformed roadway-marking strip as in claim 2, wherein said aromatic rings are from the group consisting of bisphenol and ethylene oxide; bisphenol and propylene oxide; resorcinol and ethylene oxide; resorcinol and propylene oxide; n,n bis (hydroxyethyl) aniline.

5. A preformed roadway-marking strip as in claim 3 wherein one terminal hydroxyl group of polyols is blocked by reaction with a monoisocyanate so as to make one branch of said polyol inert for the extension of the polymer chain.

6. A preformed roadway-marking strip as in claim 3 wherein a hydroxyl group of polyols is blocked by esterification with long chain fatty acids.

7. A preformed roadway-marking strip as in claim 3 wherein two hydroxyl groups of said polyol are blocked by esterification with long chain fatty acids.

8. A preformed roadway-marking strip as in claim 2 wherein the sterical hindrance is obtained by the presence in the chain of a large aromatic structure such as bis (hydroxypropyl)-bisphenol.

9. A preformed roadway-marking strip as in claim 2 wherein said lower layer includes an elastomeric composition.

10. A preformed roadway-marking strip as in claim 2, wherein said polyurethane resin film impregnates a nonwoven fabric so as to provide a very high service life.

11. A preformed roadway-marking strip as in claim 2, wherein said polyurethane resin film impregnates a non woven fabric so as to be used as a removable marking strip.

12. A preformed roadway-marking strip as in claim 2, wherein the catadioptric elements are coated with the reaction product between a chain extender and a urethane prepolymer.

* * * * *

UNITED STATES PATENT AND TRADEMARK OFFICE

CERTIFICATE OF CORRECTION

PATENT NO. : 4,990,024

DATED : February 5, 1991

INVENTOR(S) : Ludwig Eigenmann

It is certified that error appears in the above-identified patent and that said Letters Patent is hereby corrected as shown below:

Col. 3, line 15, "pblypropylene" should read --polypropylene--

Col. 6, line 2, "on is pending" should read -- one branch is pending" --.

Signed and Sealed this

Eighth Day of February, 1994

Bruce Lehman

*Attest:*

BRUCE LEHMAN

*Attesting Officer*

*Commissioner of Patents and Trademarks*